US010328471B2

(12) United States Patent
Jones et al.

(10) Patent No.: US 10,328,471 B2
(45) Date of Patent: Jun. 25, 2019

(54) EDGER FEED ROLLS

(71) Applicant: PRIMETALS TECHNOLOGIES AUSTRIA GMBH, Linz (AT)

(72) Inventors: Martyn Jones, Colehill (GB); Stuart Leflay, Sothall (GB)

(73) Assignee: PRIMETALS TECHNOLOGIES AUSTRIA GMBH (AT)

( * ) Notice: Subject to any disclaimer, the term of this patent is extended or adjusted under 35 U.S.C. 154(b) by 535 days.

(21) Appl. No.: 14/904,416

(22) PCT Filed: Jun. 26, 2014

(86) PCT No.: PCT/EP2014/063489
§ 371 (c)(1),
(2) Date: Jan. 11, 2016

(87) PCT Pub. No.: WO2015/003914
PCT Pub. Date: Jan. 15, 2015

(65) Prior Publication Data

US 2016/0144414 A1 May 26, 2016

(30) Foreign Application Priority Data

Jul. 9, 2013 (GB) ..... 1312262.7

(51) Int. Cl.
*B21B 13/06* (2006.01)
*B21B 1/34* (2006.01)
*B21B 39/14* (2006.01)

(52) U.S. Cl.
CPC ..... *B21B 1/34* (2013.01); *B21B 13/06* (2013.01); *B21B 39/14* (2013.01)

(58) Field of Classification Search
CPC ..... B21B 1/34; B21B 13/06; B21B 31/12; B21B 31/14; B21B 35/00; B21B 39/02; B21B 39/10; B21B 39/14; B21B 35/14
See application file for complete search history.

(56) References Cited

U.S. PATENT DOCUMENTS 3,160,037 A * 12/1964 Gordon ..... B21B 13/06 72/238
3,279,585 A * 10/1966 Shen ..... B21D 3/04 198/617

(Continued)

FOREIGN PATENT DOCUMENTS

CN 101108395 A 1/2008
CN 101322981 A 12/2008

(Continued)

OTHER PUBLICATIONS

Translation; JP 56-71503A, Jun. 1981.*

(Continued)

*Primary Examiner* — Edward T Tolan
(74) *Attorney, Agent, or Firm* — Ostrolenk Faber LLP

(57) ABSTRACT

A rolling mill edger includes a pair of work rolls (1, 2) and a feed roll assembly. The assembly includes one or more driven feed rolls (23) and a drive for the feed rolls. The feed roll assembly is mounted on a moveable (25) mount such that the feed roll assembly is movable by pivoting the assembly between an operative rolling position (54) in the edger and a roll change position (55) out of the edger.

17 Claims, 13 Drawing Sheets

(56) References Cited

U.S. PATENT DOCUMENTS

| | | | | | |
|---|---|---|---|---|---|
| 3,328,993 | A * | 7/1967 | Roy | B21B 39/14 | 72/238 |
| 3,364,714 | A | 1/1968 | Adair | | |
| 3,583,196 | A * | 6/1971 | Qualey | B21B 13/06 | 72/239 |
| 3,600,925 | A * | 8/1971 | Field | B21B 13/06 | 72/207 |
| 3,670,587 | A | 6/1972 | Lemper | | |
| 4,441,352 | A | 4/1984 | McDonagh et al. | | |
| 4,513,599 | A * | 4/1985 | Harris | B21B 13/06 | 72/238 |
| 5,007,272 | A * | 4/1991 | Matsunaga | B21C 47/003 | 226/195 |
| 2006/0272465 | A1* | 12/2006 | Baumer | B23D 25/12 | 83/469 |
| 2011/0030437 | A1* | 2/2011 | Eckelsbach | B21B 13/06 | 72/245 |
| 2014/0033783 | A1* | 2/2014 | Clark | B21B 39/16 | 72/251 |

FOREIGN PATENT DOCUMENTS

| | | | |
|---|---|---|---|
| CN | 202070560 | U | 12/2011 |
| CN | 102310087 | A | 1/2012 |
| GB | 1135851 | | 12/1968 |
| JP | S48-38296 | A | 6/1973 |
| JP | S 56-71503 | | 6/1981 |
| JP | S56-160602 | U | 11/1981 |
| JP | S57-92401 | U | 6/1982 |
| JP | S58-61304 | U | 4/1983 |
| JP | S59-44602 | U | 3/1984 |
| JP | S59-62806 | U | 4/1984 |
| JP | S6099404 | A | 6/1985 |
| JP | S 61-38706 | | 2/1986 |
| JP | S61-152301 | U | 9/1986 |
| JP | 2005-279671 | A | 10/2005 |
| RU | 2 123 390 | | 12/1998 |
| RU | 2 281 821 | | 8/2006 |
| SU | 1690868 | | 11/1991 |

OTHER PUBLICATIONS

International Search Report dated Oct. 2, 2014 issued in corresponding International patent application No. PCT/EP2014/063489.

International Preliminary Report on Patentability dated Jun. 26, 2015 issued in corresponding International patent application No. PCT/EP2014/063489.

Japanese Notice of Reasons for Rejection dated Apr. 17, 2017 in corresponding Japanese Patent Application No. 2016-524731 (with English language translation)(total 7 pages).

Chinese First Office Action dated Sep. 27, 2016 in corresponding Chinese Patent Application No. 201480039376.1 with Search Report (with English language translation)(total 18 pages).

Russian Office Action dated Mar. 29, 2018 issued in Russian Patent Application No. 2016103904 and English language translation.

* cited by examiner

EDGER FEED ROLLS

CROSS-REFERENCE TO RELATED APPLICATIONS

The present application is a 35 U.S.C. §§ 371 national phase conversion of PCT/EP2014/063489, filed Jun. 26, 2014, which claims priority of Great Britain Patent Application No. 1312262.7, filed Jul. 9, 2013, the contents of which are incorporated by reference herein. The PCT International Application was published in the English language.

TECHNICAL FIELD

This invention relates to a rolling mill edger, in particular for plate and Steckel mills.

TECHNICAL BACKGROUND

There is a trend in current plate and Steckel mills for the rolling of shorter feed stock such as short (usually thick) slabs or ingots. Typically, feed stock has been of the order of 3 to 4 meters or longer in length, but now there is a requirement to roll feed stock that is only of the order of 2 to 3 meters or less in length. This is particularly applicable in the case of plate mills rolling products from thick slabs or ingots and Steckel mills rolling 'exotic' materials e.g. titanium and nickel grades. These short slabs or ingots pose a particular problem with the operation of the edger.

Rolling mill edgers are used to maintain a required width of the slab as it is processed. The edgers typically comprise work rolls mounted at either side of a centerline on a section of a path over which the feed stock is moved in its various forms, for convenience referred to as a slab, but encompassing other forms from feedstock to finished product. The work roll separation is adjustable according to the plate width required. Idler rolls extend across the center part of the path, mounted with their roll axis perpendicular to and in the same plane as the centerline. Feed rolls are provided across a substantial part of the full width of the path ahead of or beyond the edger section of the path and these feed rolls are typically driven directly from motors via drive shafts, or sometimes using a gearbox. However, in the edger section of the path, between the edger work rolls, there are usually only idler rolls. This is not a problem if the slabs are of a conventional length as at least a part of the slab is always resting on driven rolls in the path outside the edger section. However, for short slabs, there may be a time in the rolling cycle when no part of the slab is on a driven roller and the slabs get stuck. Replacing the idler rollers with driven rollers in the section between the edger work rolls has the disadvantage that edger work roll changes are made more complicated because of the need to remove the driven rollers in that section to allow access for a roll change. Unlike the existing idler rollers, driven rollers cannot be simply lifted out, but would have to be disconnected from their gear and drive mechanism. JPS5671503 describes rolling equipment which can roll both plate and hot coil by providing an intermediate roller table which is raised into position for plate rolling. JPS6138706 describes an edging mill provided with a pair of non-driven edging rolls which are movable in the sheet width direction, to reduce the cost and space requirements associated with driven rolls.

SUMMARY OF THE INVENTION

In accordance with a first aspect of the present invention, a rolling mill edger comprises a pair of work rolls and a feed roll assembly; wherein the feed roll assembly comprises one or more driven feed rolls and drive means; wherein the feed roll assembly is mounted on a moveable mount such that the feed roll assembly is movable between an operative rolling position in the edger and a roll change position in the edger; and wherein the moveable mount comprises a pivot.

The driven feed rolls and their drive means are moved out of their operative position to allow a roll change to take place in the space that they occupy in normal rolling operation. Typically, the moveable mount rotates or pivots. Preferably, the pivot comprises an input shaft of the gearbox, belt drive or chain drive.

Preferably, the drive means comprises a motor and one of a gearbox, a belt drive or a chain drive.

Preferably, the edger comprises two feed roll assemblies and moveable mounts.

A feed roll assembly on a moveable mount is provided on each side, in the direction of travel of the plate, of the gap in which the edger work rolls are able to move.

Preferably, the edger further comprises one or more two part split driven feed rolls and the one or more driven feed rolls of the feed roll assembly are mounted between the two parts of one split driven feed roll.

Preferably, the edger further comprises a common support to support the two parts of the split driven feed rolls and the drive means.

In one embodiment, the drive means comprises a motor and a gearbox and the edger further comprises one or more two part split driven feed rolls and the one or more driven feed rolls of the feed roll assembly are mounted between the two parts of one split driven feed roll; and wherein the input shaft of the gearbox is coupled to one part of the split driven feed roll and adapted to be driven by the one part of the split driven feed roll.

Preferably, the other part of the split driven feed roll is coupled to the input shaft of the gearbox and adapted to be driven by the input shaft of the gearbox.

In accordance with a second aspect of the present invention, a method of carrying out edger work roll change in a rolling mill edger according to the first aspect comprises pivoting the driven feed rolls away from an operative rolling position and moving a first work roll into the location vacated by the driven feed rolls of the feed roll assembly; lifting the first work roll out of the edger; lifting a second work roll into the edger to replace the first work roll; moving the second work roll away from the operative rolling position of the driven feed rolls of the feed roll assembly; and pivoting the driven feed rolls of the feed roll assembly back into their operative rolling position. Preferably, the driven feed rolls are pivoted about a shaft of a feed roll drive mechanism.

If the first work roll is removed and renovated, it may be returned to the edger as the second work roll, after a period of time has elapsed, but preferably, the second work roll is different from the first work roll.

Preferably, the input shaft of the gearbox is driven by one part of the split driven feed roll. Preferably, the other part of the split driven feed roll is driven via the input shaft of the gearbox.

BRIEF DESCRIPTION OF THE INVENTION

An example of a rolling mill edger according to the present invention will now be described with reference to the accompanying drawings in which.

Figure 3A:
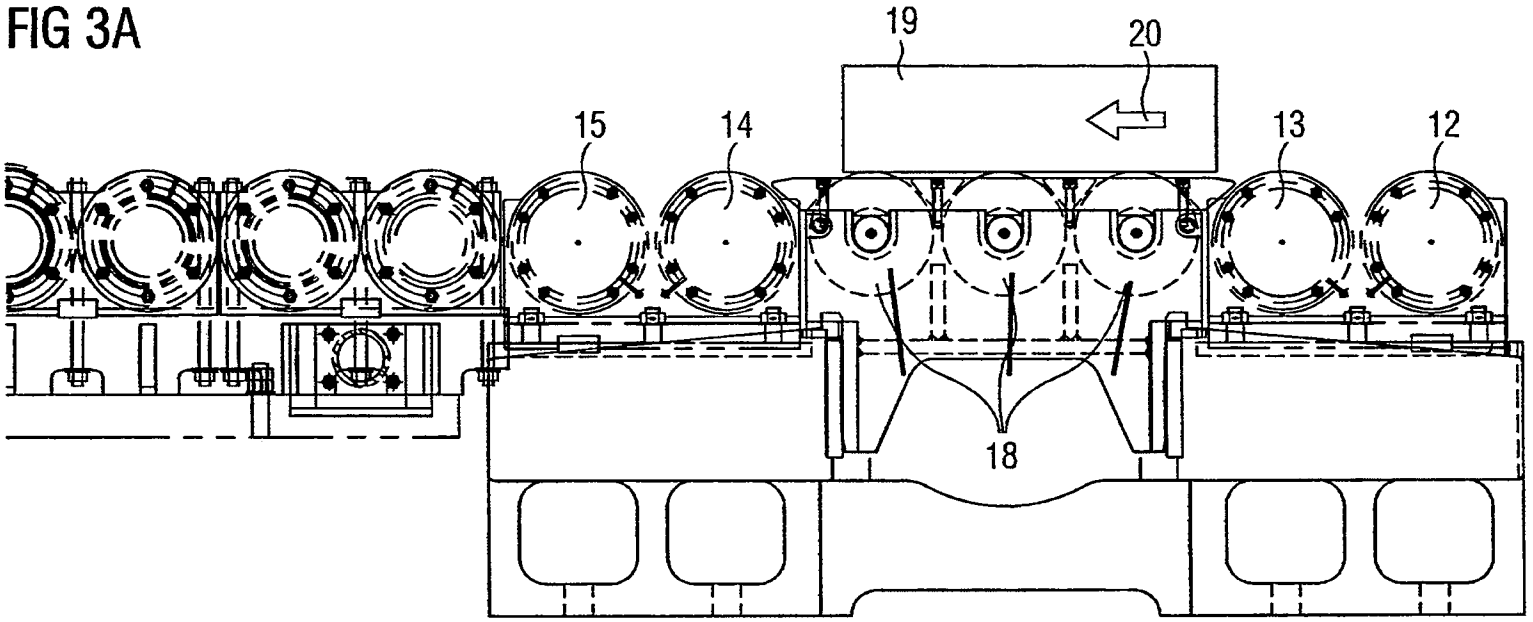
FIG 3A PRIOR ART
Figure 3B:
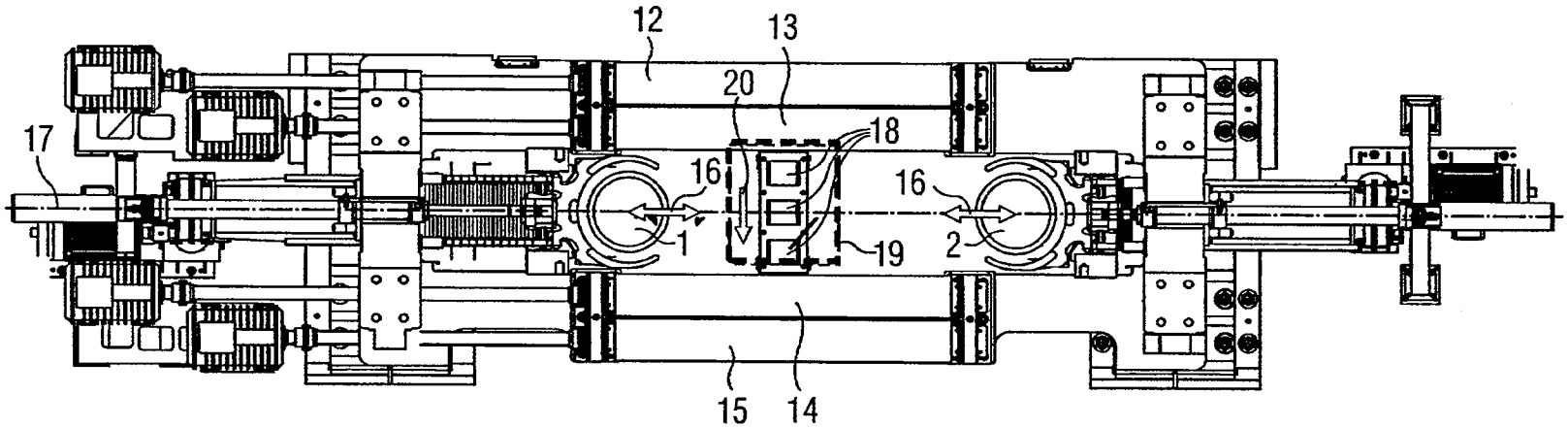
FIG 3B PRIOR ART
Figure 4:
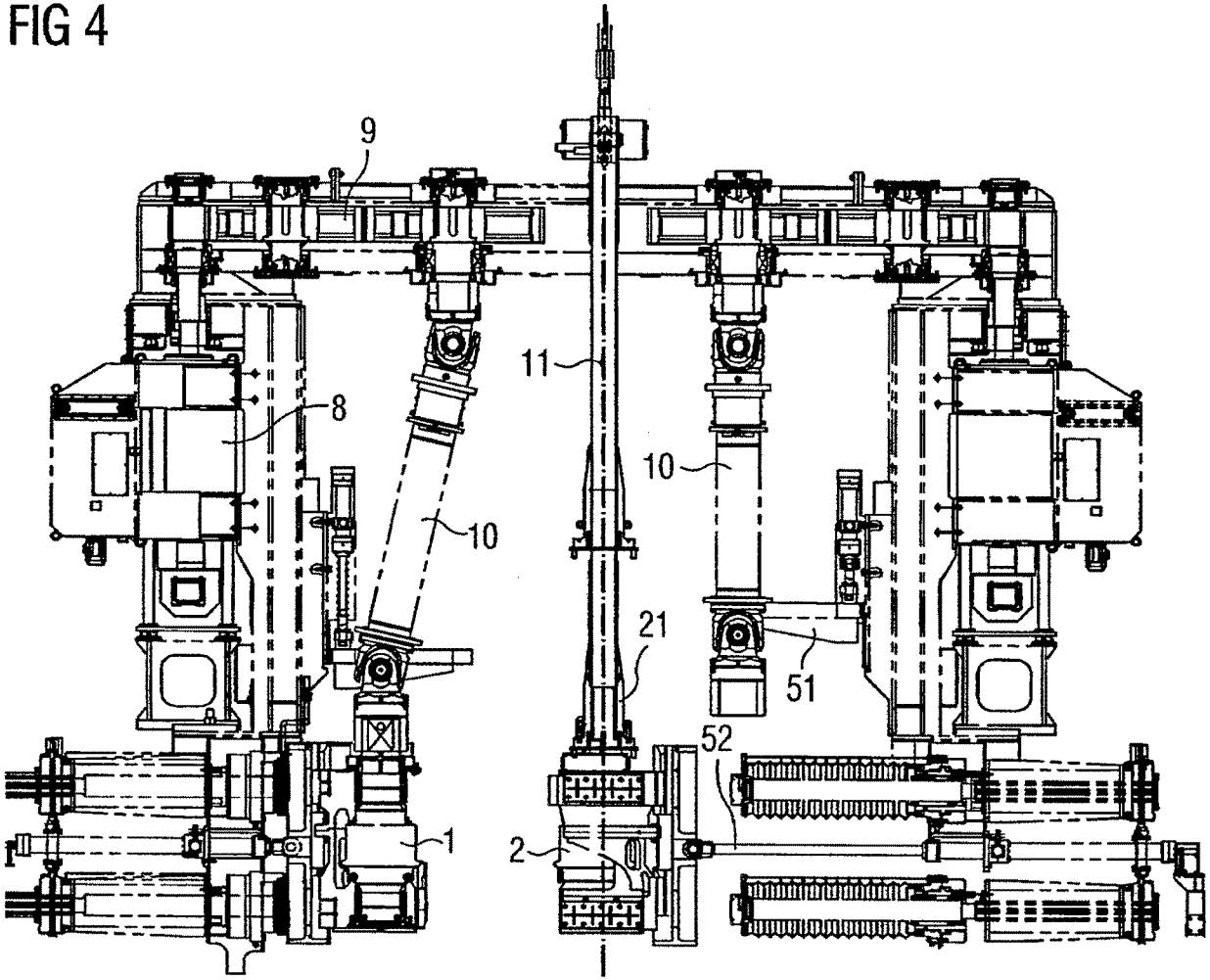
FIG 4 PRIOR ART
Figure 5A:
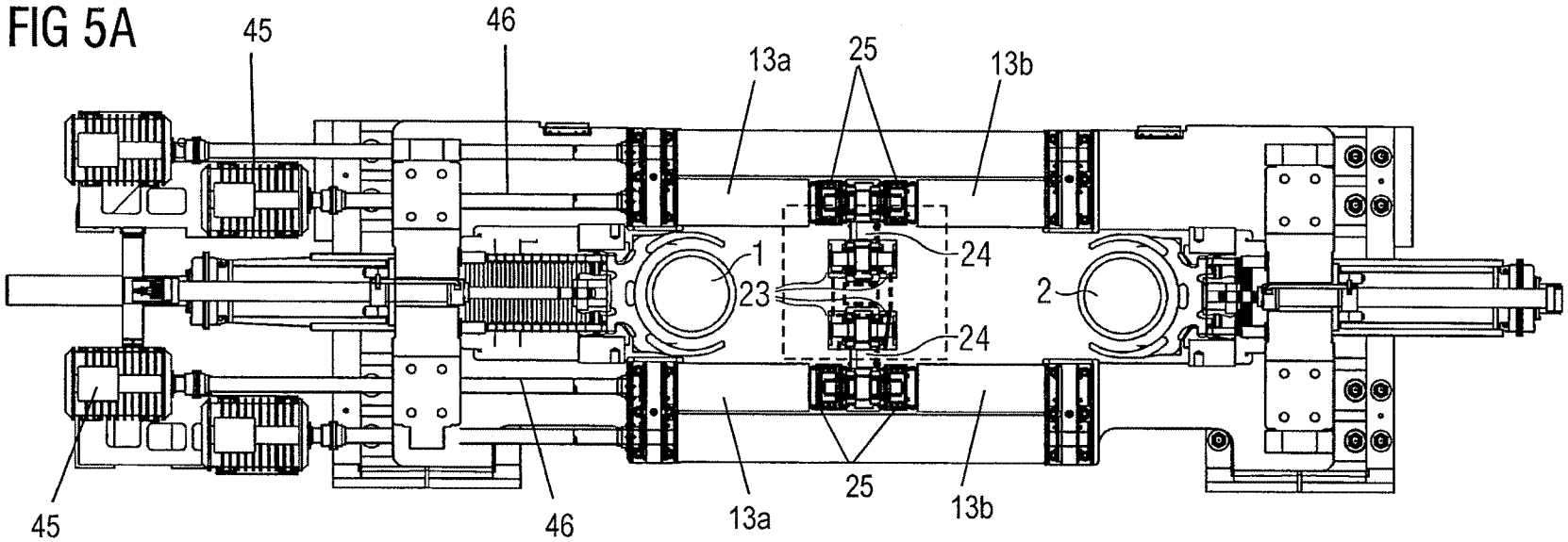
Figure 5B:
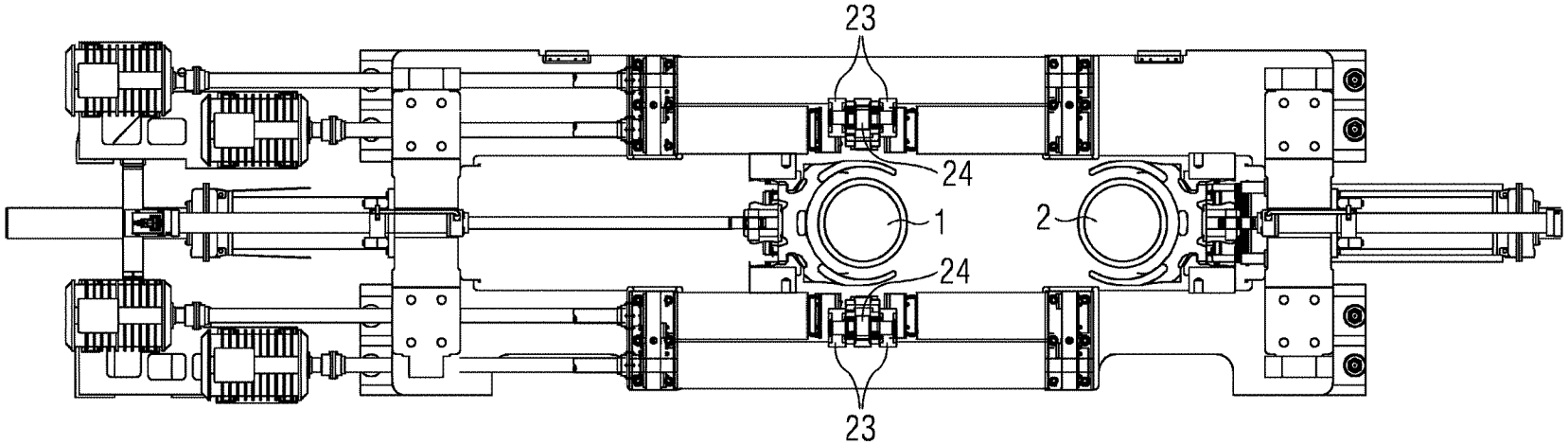

FIG. 3*a* shows the problems faced in a conventional edger processing a short slab, seen from the side;

FIG. 3*b* shows the problems faced in a conventional edger processing a short slab, seen from above;

FIG. 4 illustrates extraction of a work roll from a conventional edger, during work roll change;

FIG. 5*a* illustrates a detailed construction of an edger according to the present invention, seen from above, showing the central rollers in their operative position;

FIG. 5*b* illustrates a detailed construction of an edger according to the present invention, seen from above, showing the central rollers in their idle position;

5*c* shows the operative position from the side;

5*d* shows the roll change position from the side.

5*e* shows the roll change position with the roll chock moved in between the rolls.

Figure 6:
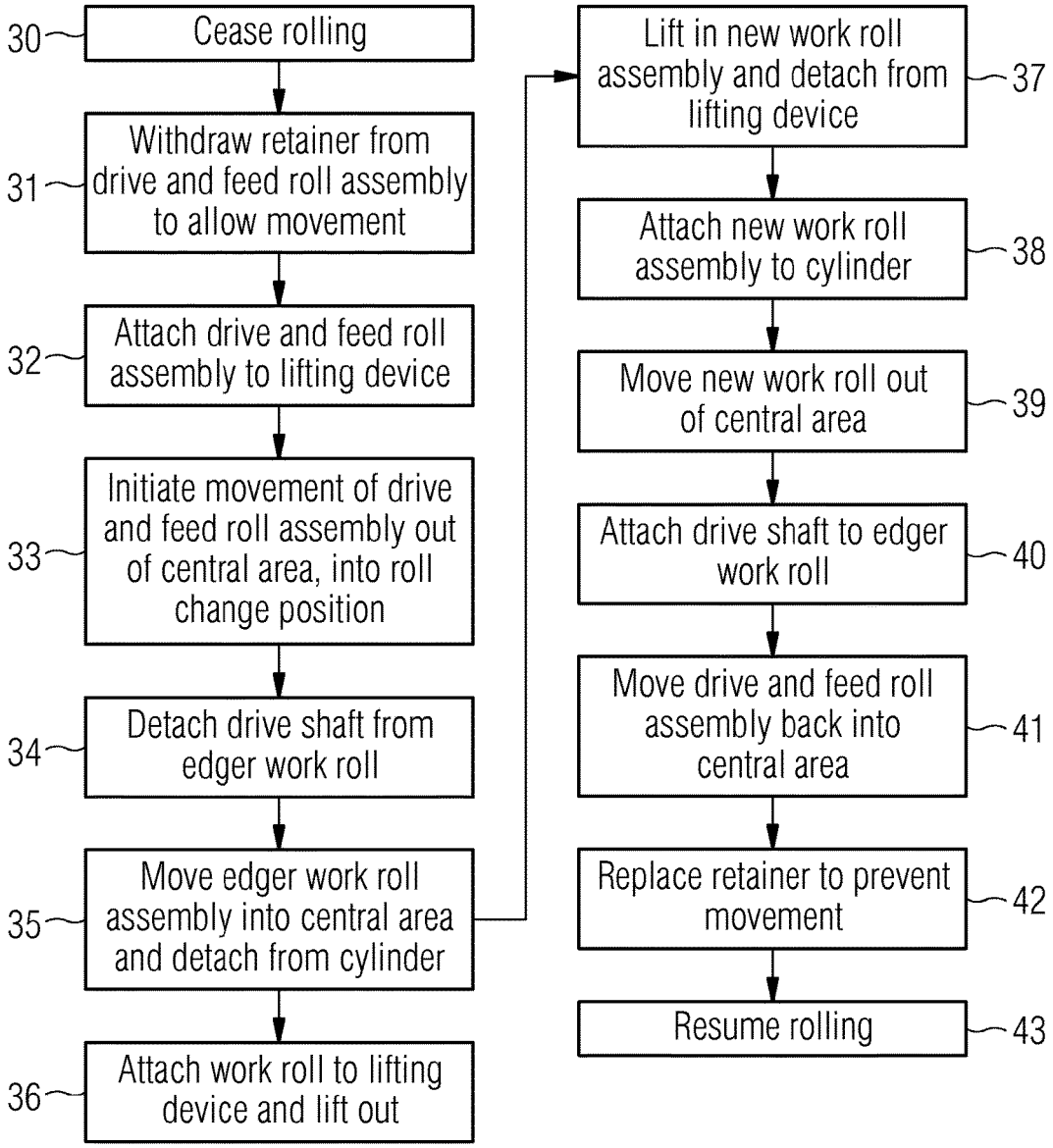

5*f* illustrates the roll change position, illustrating slide stops;

5*g* shows another view of an example of an edger according to the present invention, seen from above, showing the central rollers in the operative position; and, FIG. 6 is a flow diagram of a method of carrying out roll change in a rolling mill comprising an edger according to the present invention.

DESCRIPTION OF PRIOR ART

Figure 1:
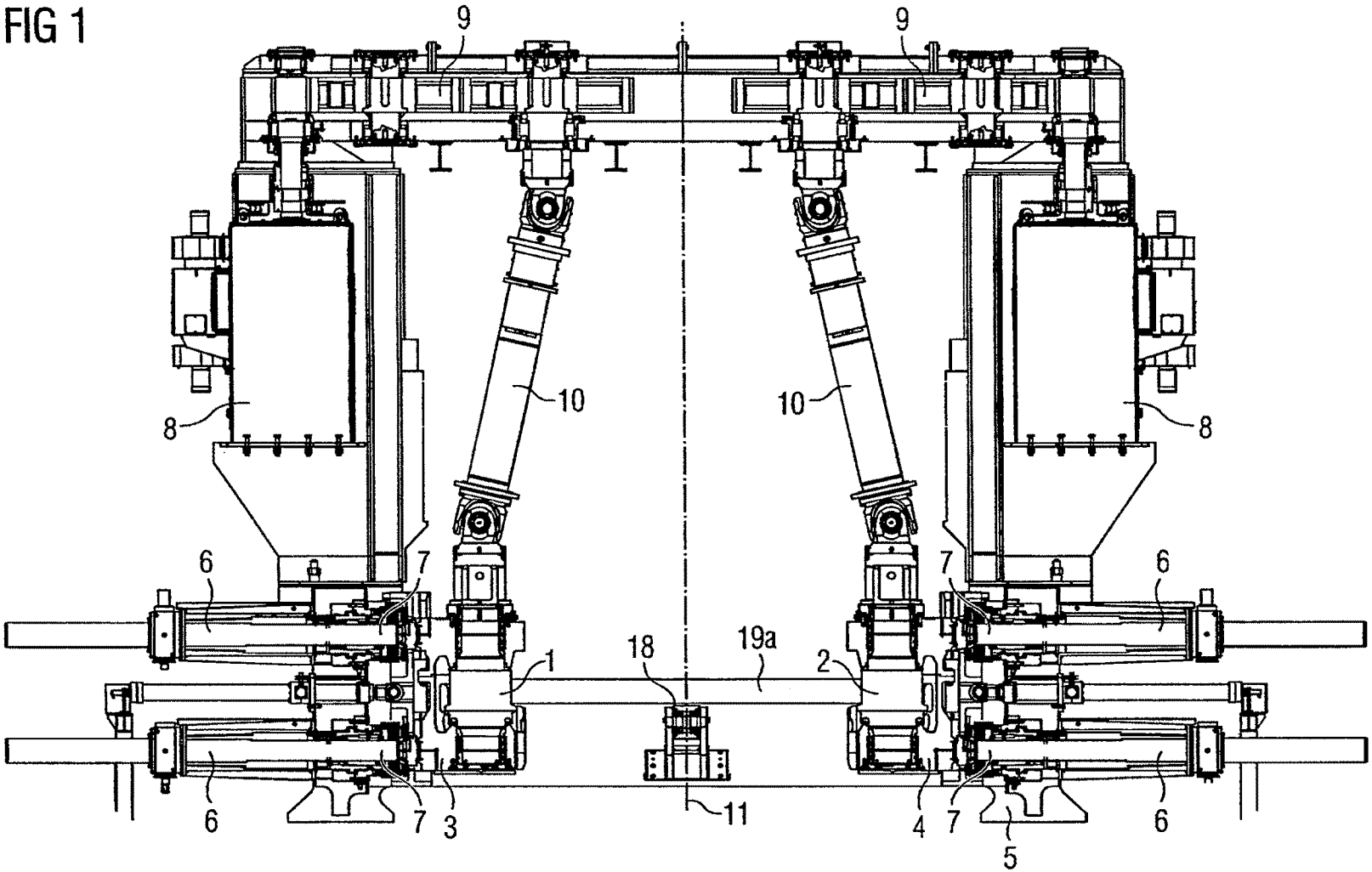
FIG 1 PRIOR ART
FIG. 1 illustrates a conventional edger with the edger positioned for a wide slab.
Figure 2:
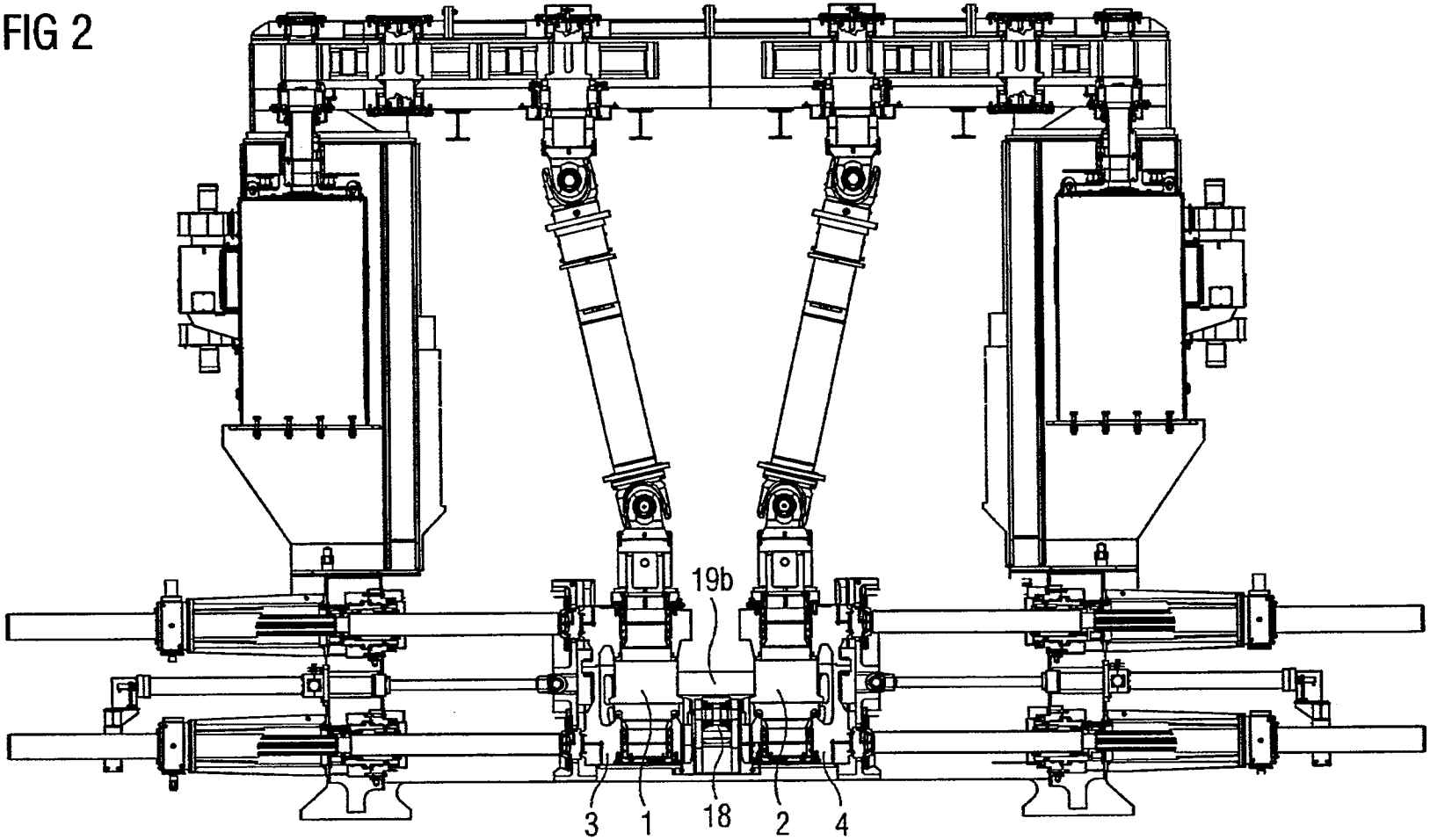
FIG 2 PRIOR ART
FIG. 2 illustrates a conventional edger with the edger positioned for a narrow slab.

In a plate mill or Steckel mill edger, for example as illustrated in FIGS. 1 and 2, edger work rolls 1, 2 are mounted in chocks 3, 4 which can be moved within a housing 5 by screws 6 and cylinders 7. The edger work rolls 1, 2 are driven by electric motors 8 via respective gearboxes 9 and driveshafts 10. Altering the separation of the edger work rolls 1, 2 about a centerline 11 of the edger, by moving the chocks 3, 4, allows the edger to be adapted to the width of slab to be rolled. In FIG. 1, a wide slab 19*a* is shown. In FIG. 2, a narrow slab 19*b* is shown. As shown in FIGS. 3A and 3B, driven feed rolls 12, 13, 14, 15 are used to support the slab, but because the edger work rolls 1, 2 move as illustrated by the arrows 16, these feed rollers have to be mounted at a distance from a centerline 17 of the edger work roll, so as not to obstruct the movement of the edger work rolls. The centerline 17 is perpendicular to the direction of travel 20 of the slab. Typically, the pitch between the two innermost driven feed rolls 13, 14 is approximately 2000 mm, i.e. 1000 mm either side of the edger work roll centerline 17. In between the innermost driven feed rollers there are usually only idler rolls 18 (i.e. un-driven rolls). The reason that these idler rolls 18 are not driven is that there is very little space available for a drive mechanism. As can be seen in FIG. 2, when the edger is edging narrow slabs 19 there is only a very small gap between the edger roll assemblies 1,2,3,4 and the idler rolls 18 and there is not enough space to install driveshafts for these idler rolls.

The fact that these idler rolls 18 are not driven causes problems with the transport of short slabs 19 or ingots through the edger because the slab or ingot can get stuck in a position where it is not being driven by any of the driven feedrollers. This is illustrated in more detail in FIGS. 3*a* and 3*b*. A short slab 19 moving in a direction of travel shown by the arrow 20 loses contact with the driven feed rolls 12, 13 before it comes into contact with the driven feed rolls 14, 15. This problem is particularly pronounced if no edging is being done on the slab, or ingot so that the edger rolls 1, 2 are not in contact with the slab 19 or ingot. In this situation, the slab or ingot only makes it through the edger if it has sufficient momentum to keep it moving. There might be some assistance from the edges of the slab resting on the top of the flanges of the edger work rolls but, particularly in the case of ingots which are usually tapered, this contact may be minimal or not present at all. There may also be small idler rolls mounted on the front face of the bottom edger roll chock. These provide some support for the slab or ingot, but they are not usually driven. Whilst in principal it would be possible to drive these support rollers it is not very practical due to limited space available.

To overcome this problem, some edgers use short, driven feed rollers which are gear driven from the center of the innermost full width feed roller. The innermost driven feed roller is divided into two parts and in between the two parts there is a gearbox which drives the small feed rollers which are located between the edger work rolls. Either a single pair of short feed rolls are driven via the gearbox, or two or more short feed rolls are driven from each side, via a train of gears. Although, this design addresses the problem of transporting short slabs through the edger, it introduces another problem.

The edger work rolls need to be changed at regular intervals due to wear. The most common method of changing the roll assemblies is to lift them vertically out of the edger housing as shown in FIG. 4. It is convenient in many large plate mill edgers to lift them with a hook 21 on the centerline 11 of the edger. One reason for this is that the gearboxes 9 and motors 8 and driveshafts 10 interfere with lifting the edger roll assemblies at other positions. Another reason is that because the central position is a non-working position it is easy to arrange for the edger roll assembly to disengage from the guides, typically slide stops 22, which retain the edger roll assembly in the edger roll housing 5 during normal operation when the edger roll assembly is in a non-central position, as illustrated in FIG. 5F and allow it to be slid out in the central position as illustrated in FIG. 5*e*, so this simplifies the roll change. Consequently many edgers move the work roll assembly into this central position for roll change as illustrated in FIG. 4.

In order to allow the edger roll assembly to move to this central position the idler rolls 18 which are illustrated in FIGS. 1, 2 and 3 have to be lifted out first. In the case of simple non-driven idler rolls this is straightforward because the group of idler rolls is mounted on a common base which can be simply lifted out by an attachment on the same lifting hook 21 which is then used to remove the edger rolls 1, 2.

However, in the case of the gear driven short feed rollers referred to above, this is not possible. The gearboxes and short feed-rollers cannot simply be lifted out for the edger roll change. Consequently, the edger roll change is made more complex because the guides 22 which retain the edger roll assemblies in the edger roll housing 5 have to be unbolted in order to take out the edger rolls 1, 2 in a non-central position.

Thus, the current options are to use an edger with idler rolls, which is better for the edger roll change, but is not very good at transporting short slabs or ingots through the edger, or to use an edger with gear driven short feed rollers, which is better at transporting short slabs or ingots, but makes the roll change more complex.

DESCRIPTION OF AN EMBODIMENT OF THE INVENTION

The present invention addresses the roll change problem associated with the gear driven type short feed rollers.

Instead of the fixed gearbox and short driven rollers used to ensure that a short slab is not stuck on idler rolls, the invention provides an assembly with driven rollers which is moveable between an operative, rolling position and a roll change position. The drive mechanism for the driven rollers may be via a gearbox, a chain drive, or a belt drive. A gearbox is preferred due to high loads, so the examples will be described with reference to a gearbox. However, they should be read as being equally applicable to the case of a chain or belt drive or other similar drive mechanism.

Figure 5C:
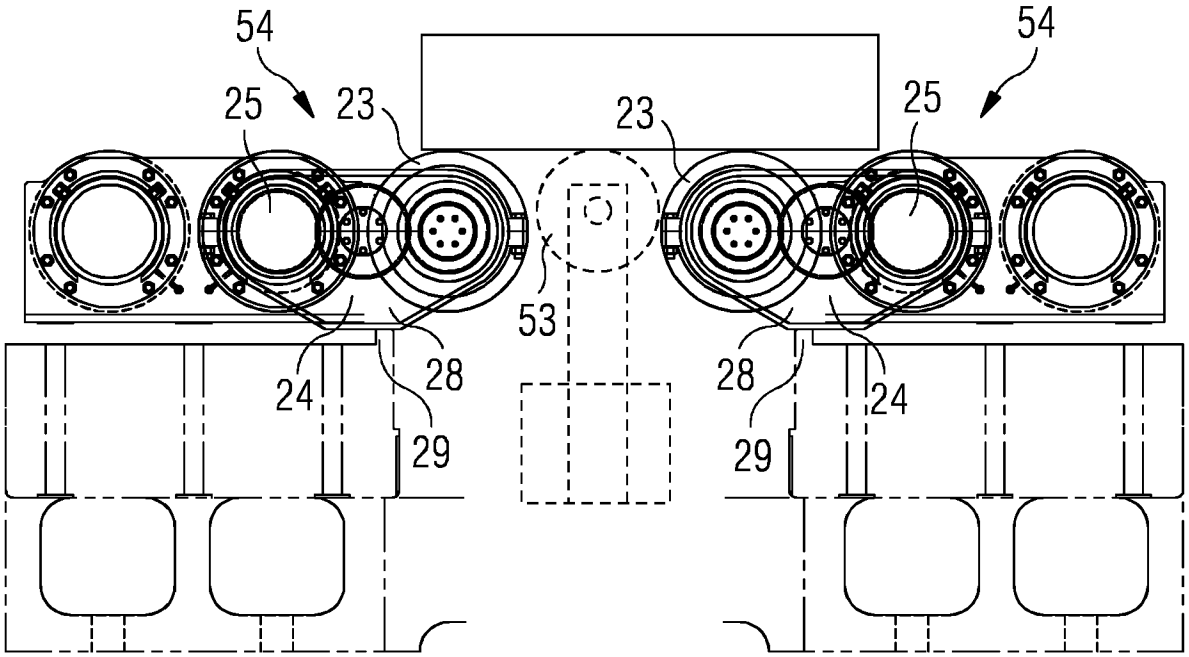
Figure 5D:
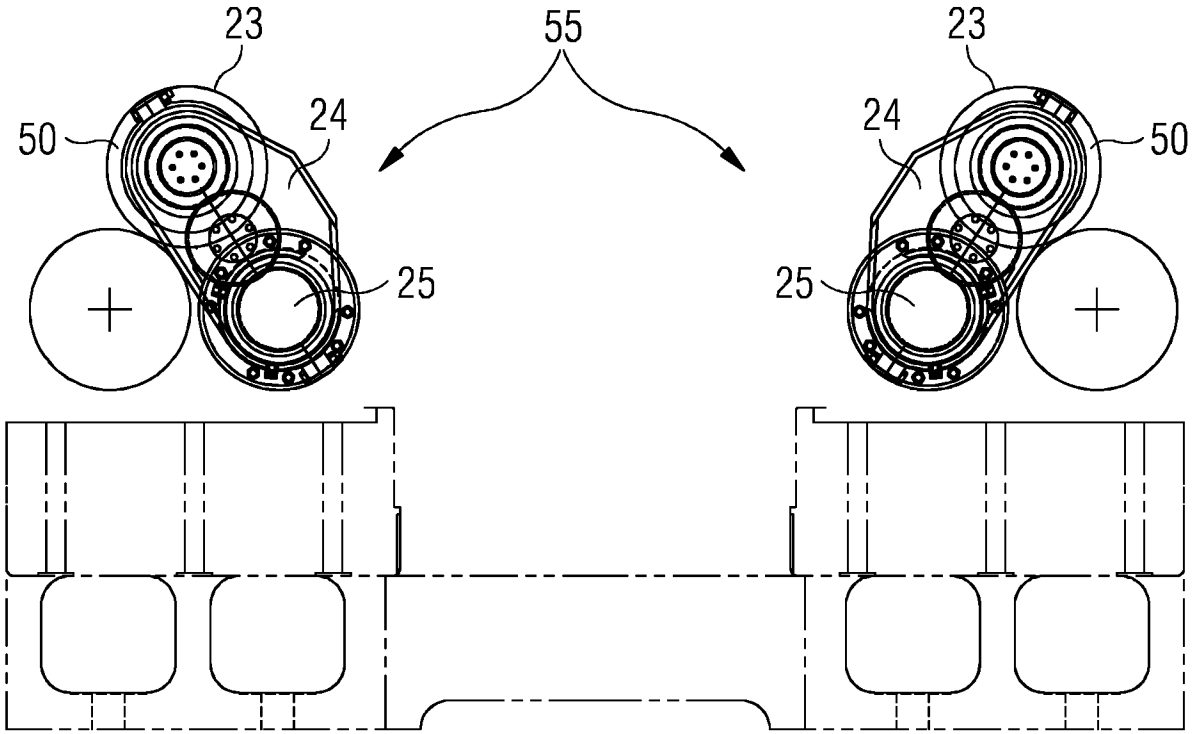
Figure 5E:
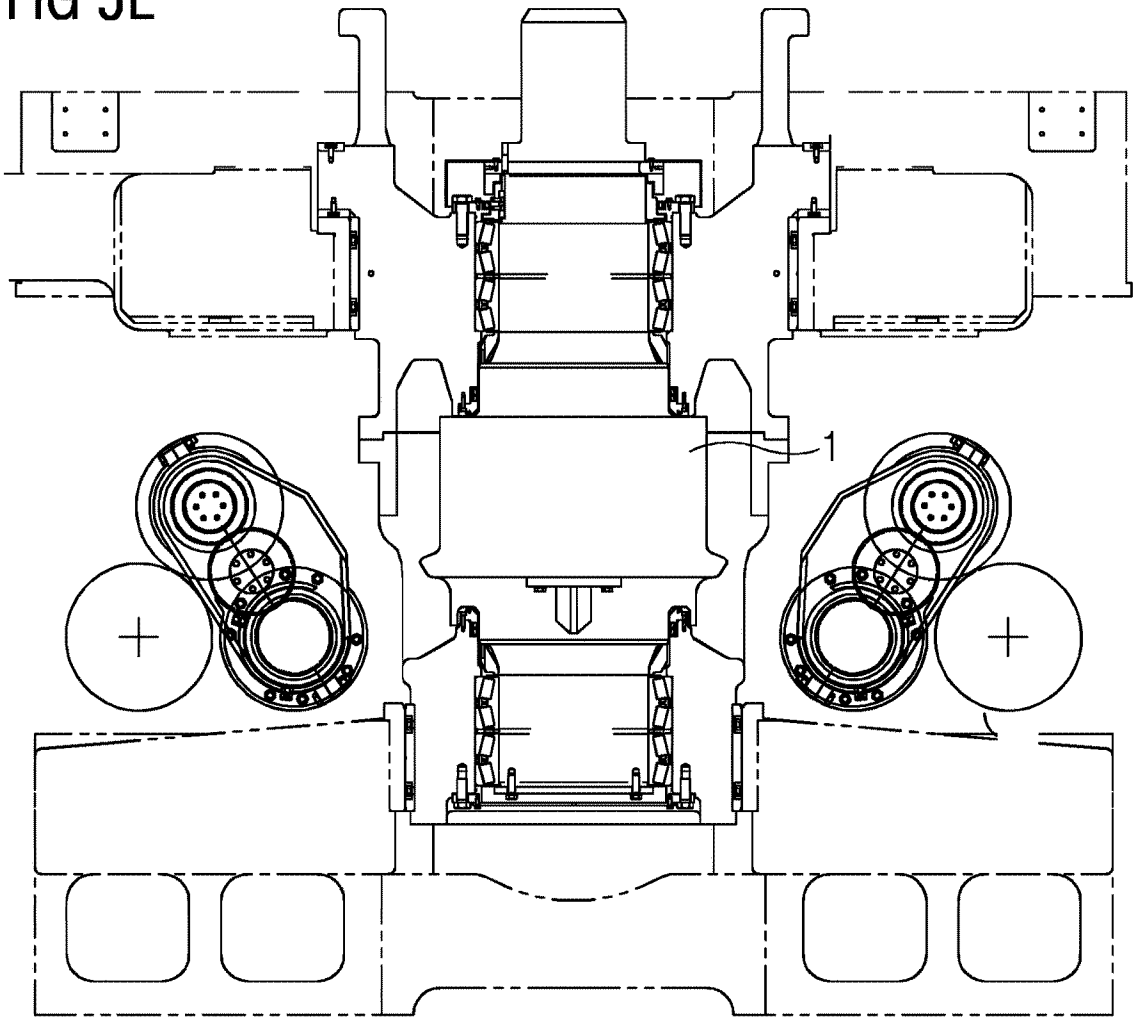
Figure 5F:
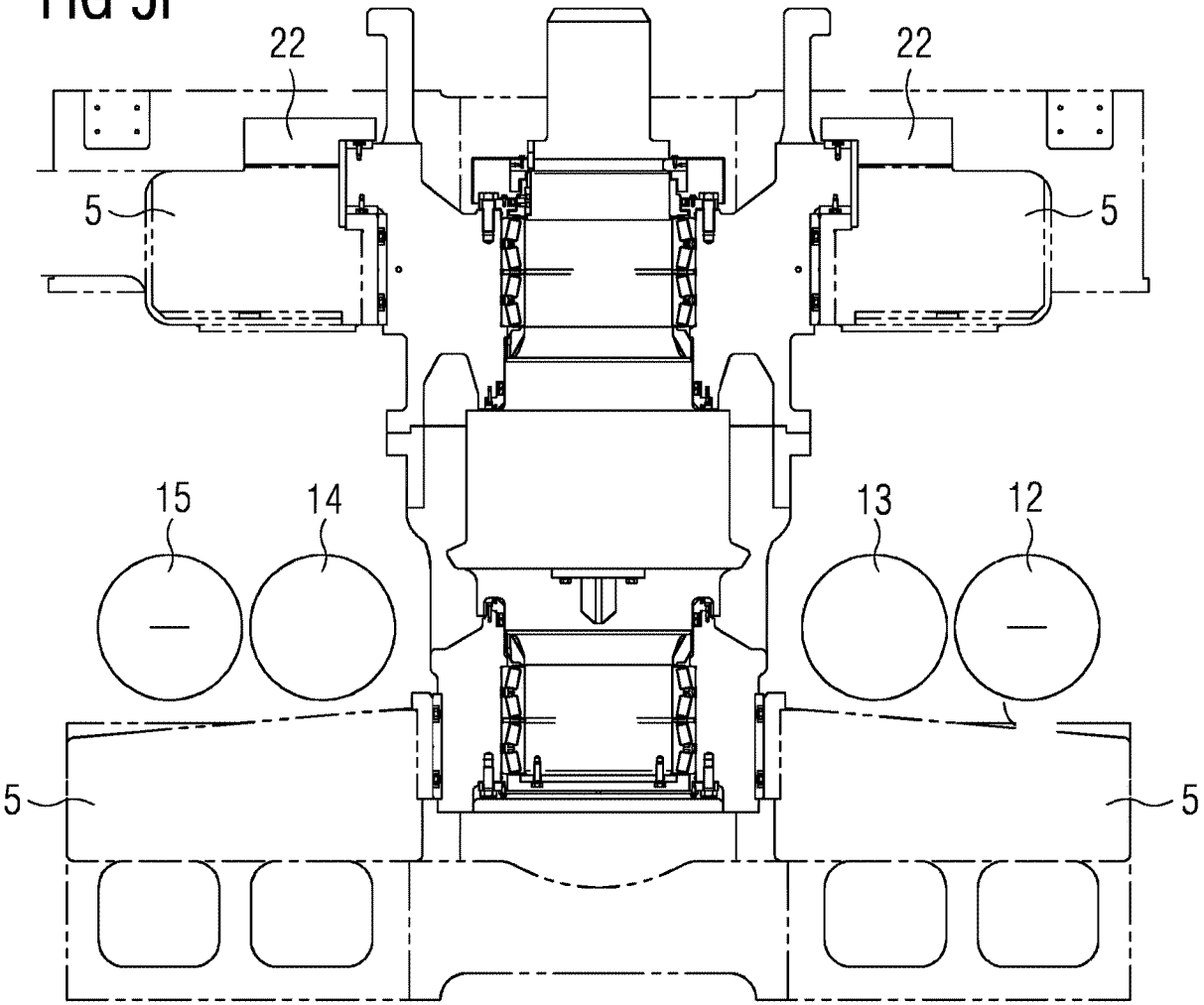

As illustrated by the embodiment of FIGS. 5A and 5C, this can be achieved by using short driven feed rollers 23, one or more feed rollers, or one or more pairs of such feed rollers, attached to and driven by a drive mechanism, in this example via a gearbox 24, which can rotate about its input shaft 25, so that the gearbox and short rollers can move between a working position 54 (FIG. 5C) where the short feed rollers fit between the edger rolls 1,2 and can be used to transport slabs through the edger as illustrated in FIGS. 5A and 5C and a roll change position 55 (FIG. 5D) in which the gearbox and the short feed rolls are rotated out of the space between the edger roll assemblies as illustrated in FIG. 5D so that the edger roll assemblies can be moved into this space for roll change as illustrated in FIGS. 5B and 5E. A single rotating gearbox may be connected to all of the one or more feed rollers, or one or more pairs of feed rollers, or a rotating gearbox may be provided on each side of the edger, connected to the feed rollers on that side. One or more non-driven idler rollers 53 may be used in addition to the short driven feed rollers 23 as illustrated in FIG. 5C.

Figure 5G:
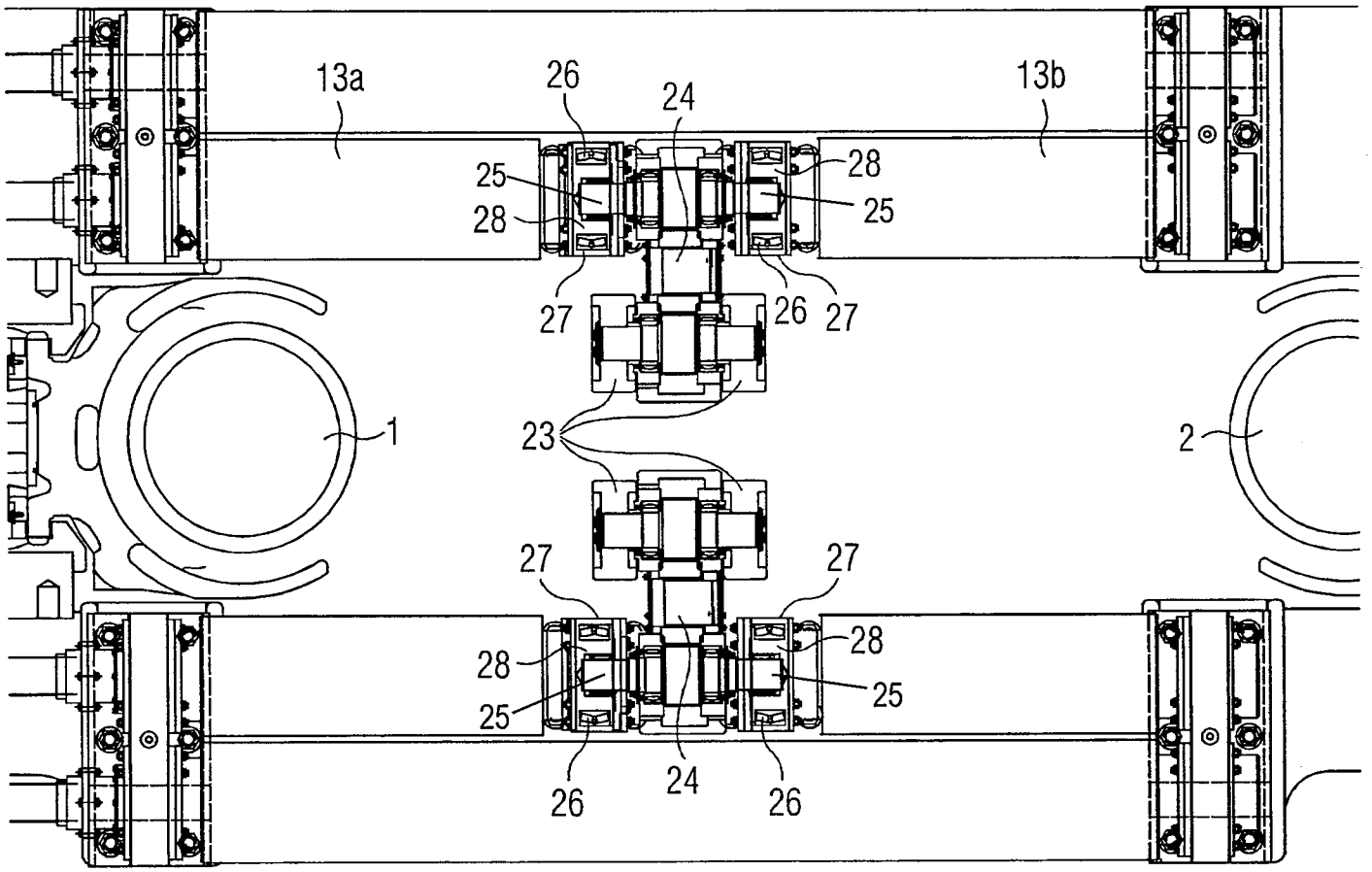

The moveable assembly comprising the gearbox 24 and short driven feed rollers 23 may be completely separate from the feed rollers 13 and 14, for example the gearbox may be mounted underneath the full width feed roller and have a separate drive shaft to the input shaft 25. Due to the limited space available though, it is preferable to drive the input shaft 25 of the gearbox 24 from a half feed roller 13*a* as illustrated in FIG. 5G. A respective motor 45 drives each drive shaft 46 to in turn drive a respective half feed roller 13*a*. The input shaft 25 passes right through the gearbox 24 and drives another half feed roller 13*b*. Bearings 26 and bearing supports 27 which support inner ends 28 of the half feed rollers 13*a* and 13*b* and the gearbox are separate from the gearbox 24 itself. In the conventional design with short driven rollers, the gearbox itself supports the inner ends of the half feed rollers because the gearbox is fixed. The cantilevered end 28 of the gearbox 24 is supported on a stop 29 in the normal operation position shown in FIG. 5C. This stop may be adjustable or the stop may simply be shimmed during installation to set the short feed roller 23 at the correct height. The cantilevered end 28 of the gearbox 24 is prevented from moving upwards during normal operation by a simple pin or similar mechanism (not shown). Alternatively, a remotely operated latch, either mechanical or hydraulic, may be used. However, given the environment in this area and the relatively infrequent edger roll changes, a simple pin or similar system is sufficient.

For the edger roll change, the cantilevered gearboxes 24 are moved into the roll change position as illustrated in FIGS. 5B and 5D. The pin or other mechanism which prevents the gearboxes from moving upwards is withdrawn and the gearboxes are lifted and pulled into the roll change position 50 by an attachment on the same crane attachment 21 which is used for the edger roll change. There is a stop (not shown) for the roll change position of the gearbox to prevent the short feed rolls 23 from making direct contact with the full width feed rolls 12, 15. The system may include hydraulic cylinders or alternative mechanisms to move the gearbox from the normal operation position to the roll change position, if desired, but this is not essential as edger roll changes take place relatively infrequently. Replacement of the gearboxes after the edger roll change has been completed is done by simply reversing the sequence.

FIG. 6 shows the steps of the typical roll change process. When it has been determined that an edger work roll requires changing, rolling ceases 30. Any retainer that holds the assembly comprising the drive mechanism and feed rolls in place is withdrawn 31 to allow the drive and feed roll assembly to move. The assembly is attached 32 to the lifting device and movement out of the central area of the edger into the roll change position is initiated 33. Typically, this means that the lifting device pivots the assembly about the gearbox input shaft. At step 34 the drive shaft 10 is detached from the edger work roll as illustrated in FIG. 4. At step 35 the edger work roll assembly to be replaced is moved into the central area by cylinder 52 and detached from the cylinder 52. The cylinder 52 is then moved back out of the way to allow the lifting device to be attached 36 and the work roll assembly is lifted out of the edger. The new work roll is lifted 37 into the central area of the edger using the lifting device, detached from this device and the cylinder 52 is moved into position and attached 38 to the work roll assembly. The work roll assembly is then moved 39 out of the central area and the driveshaft is re-attached 40. The lifting device pivots 41 the drive and feed roll assembly back into position in the central area. Any retainers for the drive and feed roll assembly are replaced 42 and rolling can resume 43.

Thus, the edger of the present invention is able to combine driven short feed rolls to make transporting of short slabs and ingots through the edger much easier with a clear central position for edger roll change. Rotation, or pivoting, of the gearbox and short feed roller assemblies about the gear input shaft moves the gearbox and short feed roller assemblies out of the window for roll change and thus allows the edger rolls to be changed in a central position which is much simpler than changing the edger rolls in a non-central position. There is no need to detach the gearbox and feed rolls at any stage in the process.

Latching and movement between the normal operation position of the drive mechanism and feed rolls and the roll change position may be carried out manually, or may be automated and operate under control of a controller (not shown).

The invention claimed is:

1. A rolling mill edger comprising:

a pair of edger work rolls located and configured to edge a feed stock fed past the work rolls;

a feed roll assembly comprising one or more driven feed rolls located and configured to feed the feed stock to be edged between the edger work rolls;

a drive configured for driving the feed rolls, the drive having an input shaft connectable to a motor; and a moveable mount comprising a pivot on which the feed roll assembly is mounted and the mount is configured so that the feed roll assembly is movable between an operative feed stock feeding position in the edger where at least one of the driven feed rolls is positioned between entry into and exit from the edger work rolls and can be operated with the drive to transport the feedstock, and a roll change position in the edger, wherein the roll change position of the feed roll assembly is configured to provide better access to the work rolls in the edger than when the feed roll assembly is in the operative position, and wherein the moveable mount is pivotable about the pivot, and the pivot comprises the input shaft of the drive.

2. An edger according to claim 1, wherein the drive comprises a motor and one of a gearbox, a belt drive and a chain drive for connecting the motor to drive the driven feed rolls.

3. An edger according to claim 2, wherein the input shaft drives the gearbox, the belt drive or the chain drive.

4. An edger according to claim 1, wherein the edger comprises two of the feed roll assemblies and a respective one of the moveable mounts for each of the feed roll assemblies.

5. An edger according to claim 1, further comprising one or more split two part driven ones of the feed rolls, each split at a location along an axis of the split feed roll, and the one or more driven feed rolls of the feed roll assembly are mounted between the two parts of one of the split driven feed rolls.

6. An edger according to claim 5, further comprising a common support supporting the two parts of the split driven feed rolls and the drive.

7. An edger according to claim 1, wherein the drive comprises a motor and a gearbox driven by the motor;

one or more two part split driven feed rolls, and the one or more driven feed rolls of the feed roll assembly are mounted between the two parts of one split driven feed roll; and the gearbox has an input shaft coupled to one part of the split driven feed roll and the input shaft is configured to be driven by the one part of the split driven feed roll.

8. An edger according to claim 7, wherein another part of the split driven feed roll is coupled to the input shaft of the gearbox and configured to be driven by the input shaft of the gearbox.

9. An edger according to claim 1, wherein the edger work rolls are spaced axially outward in the axial direction of the driven feed rolls in the operative feed stock feeding position.

10. A method of edger work roll change in a rolling mill edger according to claim 1, the method in sequence comprising:

moving at least one of the driven feed rolls of the feed roll assembly away from an operative rolling position;

moving at least a first work roll into a location vacated by the moving of the at least one of the driven feed rolls of the feed roll assembly;

lifting the first work roll out of the edger;

placing a second work roll into the edger to replace the first work roll;

moving the second work roll away from the operative rolling position of the driven feed rolls of the feed roll assembly; and moving the at least one of the driven feed rolls of the feed roll assembly back into their operative rolling position.

11. A method according to claim 10, wherein the drive includes a feed roll drive mechanism having a shaft spaced away from the feed rolls and about which the driven feed rolls are pivoted.

12. A method according to claim 10, wherein the second work roll is different from the first work roll.

13. A method of operating an edger according to claim 7, wherein the input shaft of the gearbox is driven by one part of the split driven feed roll.

14. A method according to claim 13, wherein another part of the split driven feed roll is driven via the input shaft of the gearbox.

15. A rolling mill edger comprising:

a pair of edger work rolls located and configured to edge a feed stock fed past the work rolls;

a feed roll assembly comprising one or more driven feed rolls located and configured to feed the feed stock to be edged between the edger work rolls;

a drive configured for driving the feed rolls, the drive having an input shaft connectable to a motor; and a moveable mount on which the feed roll assembly is mounted and the mount is configured so that the feed roll assembly is movable between an operative feed stock feeding position in the edger where at least one of the driven feed rolls is positioned between entry into and exit from the edger work rolls and can be operated with the drive to transport the feedstock, and a roll change position in the edger, wherein the roll change position of the feed roll assembly is configured to provide better access to the work rolls in the edger than when the feed roll assembly is in the operative position, and wherein the moveable mount is pivotable about the pivot, and the pivot comprises the input shaft of the drive.

16. An edger according to claim 15, wherein one of the edger work rolls is supported and configured to be moved between the roll change position where the driven feed rolls are located and the feedstock feeding position away from the roll change position for providing a space between the edger work rolls for the feed stock to be fed past the edger work rollers.

17. An edger according to claim 16, wherein the driven feed rollers occupy an axial space narrower than a space between the edge work rollers in their feeding feed stock positions.

* * * * *